US006389718B1

(12) United States Patent
Joo

(10) Patent No.: US 6,389,718 B1
(45) Date of Patent: May 21, 2002

(54) OPENING/CLOSING APPARATUS OF PETALS OF ARTIFICIAL FLOWERS

(75) Inventor: Soon-Suk Joo, Seoul (KR)

(73) Assignee: Dong-Hwa Lee, Seoul (KR)

( * ) Notice: Subject to any disclaimer, the term of this patent is extended or adjusted under 35 U.S.C. 154(b) by 0 days.

(21) Appl. No.: 09/503,405

(22) Filed: Feb. 14, 2000

(30) Foreign Application Priority Data

Feb. 12, 1999 (KR) ..... 99-2277
Jan. 18, 2000 (KR) ..... 00-1297

(51) Int. Cl.[7] ..... G09F 19/02; A41G 1/00
(52) U.S. Cl. ..... 40/439; 40/412; 428/24
(58) Field of Search ..... 40/411, 412, 427, 40/439; 428/24; 446/167, 199

(56) References Cited

U.S. PATENT DOCUMENTS 530,870 A * 12/1894 Wenger ..... 40/411
549,039 A * 10/1895 Wenger ..... 40/411
3,471,964 A * 10/1969 Cherry et al. ..... 446/268
4,986,531 A * 1/1991 Snaper et al. ..... 40/407 X
5,090,569 A * 2/1992 Nissen et al. ..... 446/487 X
5,756,166 A * 5/1998 Shinohara ..... 428/24
5,946,835 A * 9/1999 Boyd ..... 40/412

* cited by examiner

*Primary Examiner*—Brian K. Green
(74) *Attorney, Agent, or Firm*—Merchant & Gould P.C.

(57) ABSTRACT

An opening/closing apparatus of petals of artificial flowers adapted to unfold and fold petal members like a natural flower. The apparatus has an expansion member internally disposed underneath a body to expand during absorption of liquid or to shrink during evaporation of the liquid; a medium member disposed above the expansion member to upwardly move according to expanding force of the expansion member; a restoring member coupled to an upper side of the medium member to downwardly move the medium member according to resilience; and a plurality of petal members respectively hinged to periphery of the body, each at a predetermined height to unfold outwardly when the medium member descends or to fold inwardly when the medium member ascends. Attentively, the apparatus has a flexible member coupled to an upper side of the body to flexibly move vertically according to expansion or shrinkage of the expansion member; and a plurality of petal members respectively attached to center and peripheral sides of the flexible member, each distanced at a predetermined space relative to the upper side of the flexible member to outwardly unfold when the upper side of the flexible member is convexly and upwardly elongated or to inwardly fold when the upper side of the flexible member is concavely and downwardly shrunk.

8 Claims, 6 Drawing Sheets

OPENING/CLOSING APPARATUS OF PETALS OF ARTIFICIAL FLOWERS

BACKGROUND OF INVENTION

1. Field of the Invention

The present invention relates to artificial flowers, and more particularly to an open/closing apparatus of petals of artificial flowers.

2. Background of the Invention

A natural flower has a short life, such that artificial flowers made of plastic or the like are widely used in offices for ornamental purposes. In most cases, the artificial flowers are made with petals being unfolded.

However, the artificial flowers thus produced do not give a lively feeling, thereby not providing a pleasant feeling to their watchers.

SUMMARY OF THE INVENTION

The present invention is disclosed to solve the aforementioned problem and it is an object of the present invention to provide an open/closing apparatus of petals of artificial flowers adapted to open and close petals of the artificial flowers as occasion demands to give a liveliness thereto.

It is another object of the present invention to provide an opening/closing apparatus of petals of artificial flowers adapted to obtain a maximum ornamental effect at a reasonal price.

In accordance with one object of the present invention, there is provided an opening/closing apparatus of petals of artificial flowers, the opening/closing apparatus of petals of artificial flowers comprising:

- an expansion member internally disposed underneath a body to expand during absorption of liquid or to shrink during evaporation of the liquid;
- a medium member disposed above the expansion member to upwardly move according to expanding force of the expansion member;
- a restoring member coupled to an upper side of the medium member to downwardly move the medium member according to resilience; and
- a plurality of petal members respectively hinged to periphery of the body, each at a predetermined height to unfold outwardly when the medium member descends or to fold inwardly when the medium member ascends.

In accordance with another object of the present invention, there is provided an opening/closing apparatus of petals of artificial flowers, the opening/closing apparatus of petals of artificial flowers comprising:

- an expansion member disposed above a body to expand when liquid is absorbed or to shrink when the liquid is evaporated;
- a flexible member coupled to an upper side of the body to flexibly move vertically according to expansion or shrinkage of the expansion member; and
- a plurality of petal members respectively attached to center and peripheral sides of the flexible member, each distanced at a predetermined space relative to the upper side of the flexible member to outwardly unfold when the upper side of the flexible member is convexly and upwardly elongated or to inwardly fold when the upper side of the flexible member is concavely and downwardly shrunk.

BRIEF DESCRIPTION OF THE DRAWINGS

For fuller understanding of the nature and objects of the invention, reference should be made to the following detailed description taken in conjunction with the accompanying drawings in which:

FIG. 1 is a longitudinal sectional view for illustrating a folded state of petal members in the opening/closing apparatus of petals of artificial flowers according to the present invention, FIG. 2 is a plan view for illustrating a folded state of petal members in the opening/closing apparatus of petals of artificial flowers and FIG. 3 is a longitudinal sectional view for illustrating an unfolded state of petal members in the opening/closing apparatus of petals of artificial flowers according to the present invention;

FIG. 5 is a perspective view for illustrating an artificial flower according to the present invention, FIG. 6 is an exploded perspective view for illustrating an opening/closing apparatus of petals of artificial flowers according to the present invention, FIG. 7 is a longitudinal sectional view for illustrating a folded state of petal members in the opening/closing apparatus of petals of artificial flowers according to the present invention, and FIG. 8 is a longitudinal sectional view for illustrating an unfolded state of petal members in the opening/closing apparatus of petals of artificial flowers according to the present invention.

DETAILED DESCRIPTION OF THE INVENTION

Figure 2:
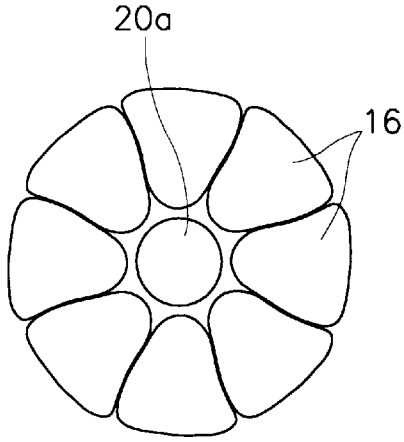
Figure 3:
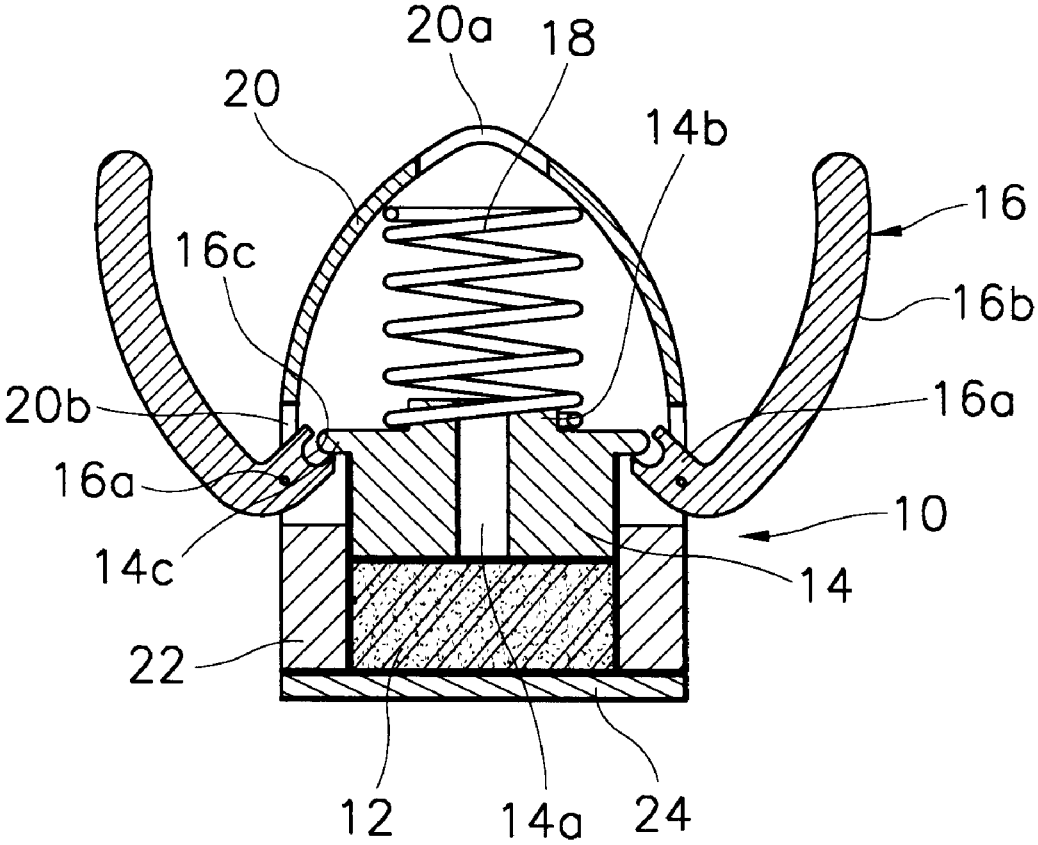

The first embodiment of the present invention will be described in detail with reference to FIGS. 1, 2 and 3.

The opening/closing apparatus of petals of artificial flowers according to the present invention includes a body 10, an expansion member 12 containing an acrylic acid polymer natrium salt internally disposed underneath the body 10 to expand during absorption of liquid or to shrink during evaporation of the liquid, a medium member 14 disposed above the expansion member 12 to upwardly move according to expanding force of the expansion member 12, a restoring member coupled to an upper side of the medium member 14 to downwardly move the medium member 14 according to resilience and a plurality of petal members 16 respectively hinged to periphery of the body 10, each at a predetermined height to unfold outwardly when the medium member 14 descends or to fold inwardly when the medium member 14 ascends.

At this time, the body 10 further includes an upper side unit 20 and a lower side unit 22, each separably manufactured to facilitate the petal members 16 and the medium member 14 disposed thereon, and both units 20 and 22 are fixed at a facing position.

The upper side unit 20 is centrally formed at an upper end surface thereof with a hole 20*a* for liquid to be infused into the body 10. The lower side unit 22 is mounted thereunder with a cover member 24 by way of coupling nuts A boundary part between the upper side unit 20 and the lower side unit 22 is circumferentially formed with a side hole 20*b* such that a root unit (described later) of the petal members 16 can be inwardly protruded into the body 10. The side hole 20*b* is formed at a circumferential portion thereof with a grooved band (no referential number given) for a hinge shaft member 26 into which petal members 16 are inserted to be tightly secured. Furthermore, the expansion member 12 is made of acrylic acid polymer natrium salt, where a chemical formula thereof is given as below;

$(C_3H_4O_2)_n$.n Na, where, n is constant.

The acrylic acid polymer natrium salt may be intrinsically contained in a flexible cover, the flexible cover being formed with a plurality of holes into which liquid can be infused.

The medium member 14, a member sliding inside the body 10, is centrally formed with a through hole 14*a*, such that the liquid infused through the hole 20*a* can flow to the expansion member 12, and is disposed thereon with a protruding unit 14*b* for the restoring member 18 to be inserted thereinto. The medium member 14 is further arranged at an upper lateral surface thereof with another protruding unit 14*c* so as to be inserted into the petal member 16 to thereby shake the petal members 16.

The petal member 16 is provided thereunder with a root unit 16*a* so as to be inserted into the body 10 and to thereby be coupled to the medium member 14.

The root unit 16*a* is mounted thereon with a wing unit 16*b* extended to an external upper side of the body 10 and having a petal shape. The root unit 16*a* is also formed with a hole (no referential number is given) through which the binge shaft member 26 is inserted.

Furthermore, the root unit 16*a* is disposed with a groove 16*c* for accommodating the protruding unit 14*c* of the medium member 14. The restoring member 18 is a coil spring for downwardly applying a resilient force and elastic modulus of the coil spring is properly maintained in consideration of expansion power of the expansion member 12. The hinge shaft member 26 is bent in a ring shape and connected along the grooved band (not shown) formed at a periphery of the body 10.

Next, an opening/closing apparatus of petals of artificial flowers according to the first embodiment of the present invention thus constructed will be described in detail.

Figure 1:
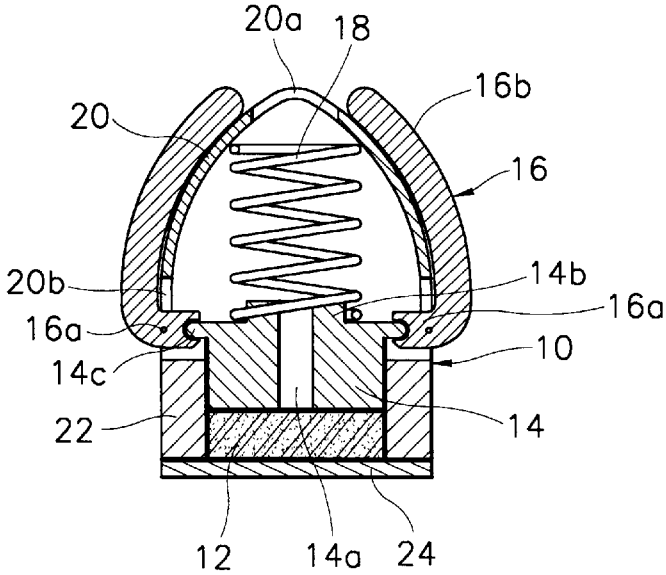
FIGS. 1, 2 and 3 are schematic drawings for illustrating a first embodiment of the present invention, where.

When the expansion member 12 is not expanded, wing unit 16*b* at the petal member 16 is adhered to the body 10 as illustrated in FIG. 1 In other words, when the restoring member 18 pushes down the medium member 14 the protruding unit 14*c* at the medium member 14 pushes down the root unit 16*a* of the petal members 16 to thereby rotate the wing unit 16*b* of the petal members 16 toward the body 10.

Successively, when the wing unit 14*b* at the petal member 16, being adhered to the body 10, is provided with liquid through the hole 20*a* of upper side unit 20 at the body 10 the liquid flows down through the through hole 14*a* of the medium member 14 to reach the expansion member 12, where the acrylic acid polymer natrium salt of the expansion member 12 absorbs the liquid to push up the medium member 14 by way of expansion force.

Furthermore, the wing unit 16*b* of the petal member 14 is slantedly distanced from the body 10 when the protruding unit 14*c* at the medium member 14 pushes up the root unit 16*a* of the petal member 16, thereby changing the petal members 16 to externally-unfolded petal shapes.

At this time, when moisture is evaporated into the atmosphere, the expansion member 12 is slowly shrunk whereas the restoring member 18 pushes down the medium member 14 at all times, thereby changing the petal members 16 to internally-folded petal shapes, as illustrated in FIG. 1.

Figure 4:
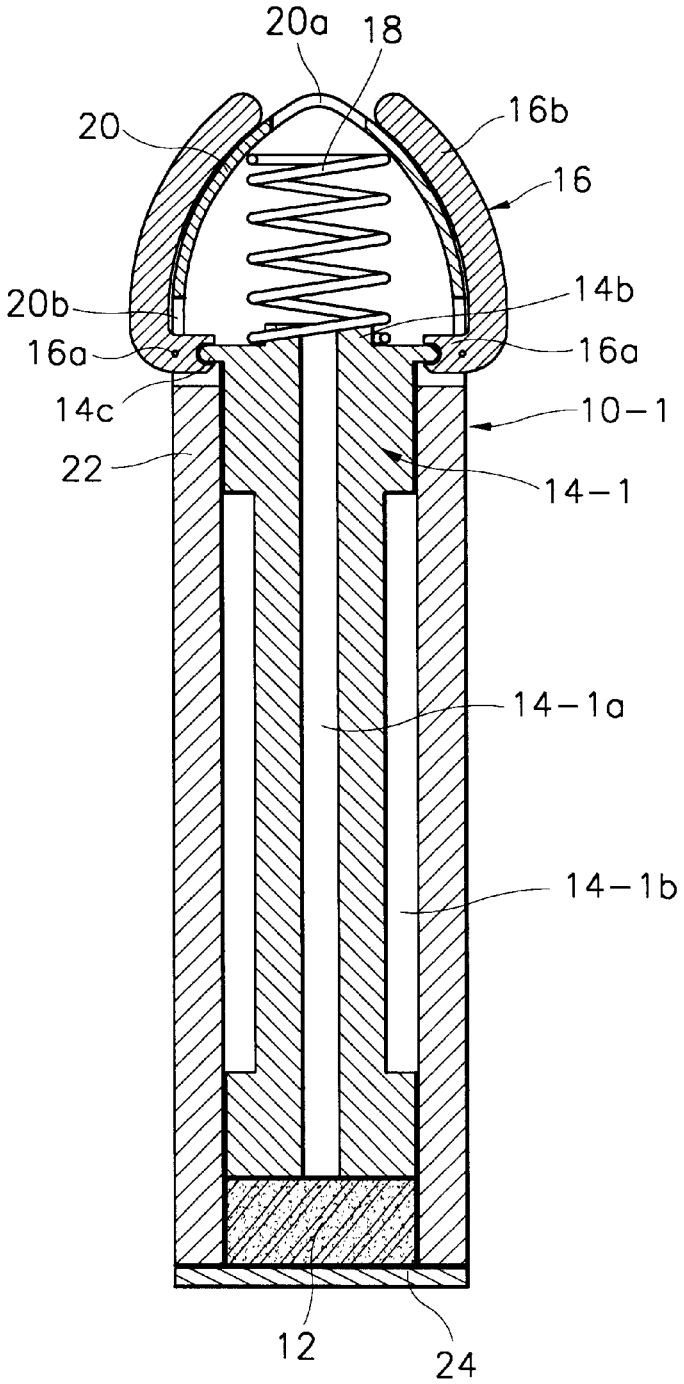
FIG. 4 is a longitudinal sectional view for illustrating an opening/closing apparatus of petals of artificial flowers according to a second embodiment of the present invention.

Now, the second embodiment of the present invention will be described in detail with reference to FIG. 4.

By way of reference, throughout the drawings, like reference numerals and symbols are used as in FIG. 1 for designation of like or equivalent parts or portions for simplicity of illustration and explanation, and detailed description thereto will be omitted.

An open/closing apparatus of petals of artificial flowers according to the present invention can also be elongated with a medium member 14-1 and a body 10-1 downwardly.

In other words, the cylindrical body 10-1 is configured to allow medium member 14-1 to vertically move and the body 10-1 is further configured so as to contact a lower end of the medium member 14-1. The body 10-1 is attached thereunder with a cover member 24 for sealing the expansion member 12 lest it should be exposed externally.

The medium member 14-1 is centrally and vertically formed with a through hole 14-1*a* such that liquid infused from a hole 10*a* formed at an upper central part of the upper side unit 20 passes therethrough and is supplied to the expansion member 12. The medium member 14-1 is formed at a central periphery thereof with a concave unit 14-1*b* for reducing frictional force when adhered to an inner circumference of the body 10-1.

Next, the third embodiment of the present invention will be described in detail with reference to FIGS. 5, 6, 7 and 8.

An opening/closing apparatus of petals of artificial flowers according to the present invention includes an expansion member 50 centrally formed at a body 40 and containing acrylic acid polymer natrium salt which expands when liquid is absorbed and shrinks when the liquid evaporates, a flexible member 60 coupled to an upper part of the body 40 for simultaneously and vertically shrinking according to expansion and shrinkage motions of the expansion member 50, a plurality of inner petal members 70 respectively attached to more central and more peripheral locations with each spaced relative to an upper surface of tile flexible member 60 for being outwardly unfolded when the upper surface of the flexible member 60 is convexly elongated upwardly and for being inwardly curled up when the upper surface of the flexible member 60 is concavely shrunk downwardly, outer petal members 80 formed at a lower part of the body 40 for encompassing the body 40, flexible member 60 and the plurality of inner petal members 70, calyx members 90 centrally coupled to the lower part of the body 40 for supporting a lower part of the outer petal members 80, and petiole members 100 centrally coupled to the lower part of the body 40 for being positioned at the calyx members.

The body 40 is semi-circularly curved downwardly at a central part thereof, and is formed at a peripheral floor thereof with drainage holes 42, each at a predetermined space, for liquid of the expansion member 50 to be drained and evaporated externally The body 40 is vertically disposed at an external lower center thereof with a connecting shaft 44 for the calyx member 90 to be fitted into periphery and concurrently for the petiole member 100 to be axially fitted. The body 40 is provided at a floor thereof with a mesh member 46, lest the expansion member 50 accommodated on the body 40 should be externally protruded through the drainage hole 42.

The expansion member 50 is stacked and compressed in multiple layers to get easily expanded when the liquid is absorbed and readily shrunk when the liquid is evaporated.

The flexible member 60 is formed at a lower periphery thereof with a flange 61 so as to be fitted into a periphery of the body 40, and upwardly disposed at a central upper surface thereof with a hinge shaft 62 for the inner petal member 70 to be fitted into the periphery. The flexible member is formed at an upper inner circumference thereof, each at a predetermined space, with a plurality of through holes 63 for the liquid to pass therethrough. The flexible member 60 is integrally mounted at an upper external circumference thereof each at a predetermined space with a plurality of first and second slant protruders 64 and 65, such that wing unit 72 of the inner petal members 70 can be respectively attached thereto via root unit 74.

The plurality of first slant protruders 64 and the plurality of second slant protruders 65 are alternatively positioned around the upper external circumference of the flexible member 60, each at a predetermined interval therebetween, where the plurality of second slat protruders 65 are respectively situated at more external positions than the plurality of the first slant protruders 64.

Furthermore, the plurality of second slant protruders 65 arc respectively formed at external upper surfaces thereof with grooves 66 for the root units 74 to be insertedly fitted thereinto each at a predetermined depth. The inner petal members 70 include a plurality of wing units 72 and root units 74, each attached thereto by adhesive agent. The outer petal members 80 comprise a plurality of wing units 82, where each wing unit 82 encompasses the body 40 and is attached at one side thereof to root unit 74 of the inner petal member 70 formed at the second slant protruder 65 of the flexible member 60, whereas the wing unit 82 is formed a central lower end thereof with a hole 84 to allow a peripheral surface of the connecting shaft 44 protruded at a lower central part of the body 40 to be fitted thereto.

The calyx members 90 are respectively and centrally formed with through holes 92 for the peripheral surface of the connecting shaft 44 protruded at the lower central part of the body 40 to be fitted thereinto.

The petiole members 100 are each formed at an upper end thereof with a protruding insertion shaft 102 for simultaneously coupling to an inner and outer circumference of the connecting shaft centrally protruded at a lower part of the body 40.

Next, the opening/closing apparatus of petals of artificial flowers according to the third embodiment of the present invention thus constructed will be described in detail.

Figure 5:
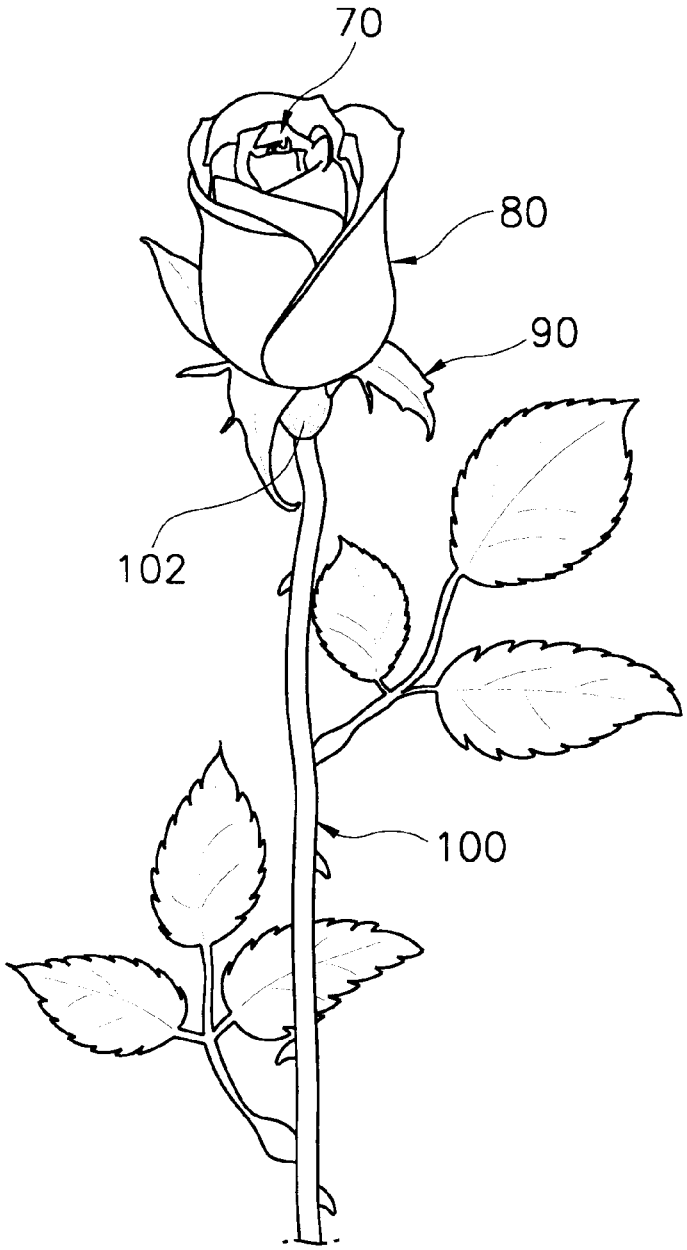
FIGS. 5, 6, 7 and 8 are schematic drawings for illustrating a third embodiment of the present invention, where.
Figure 6:
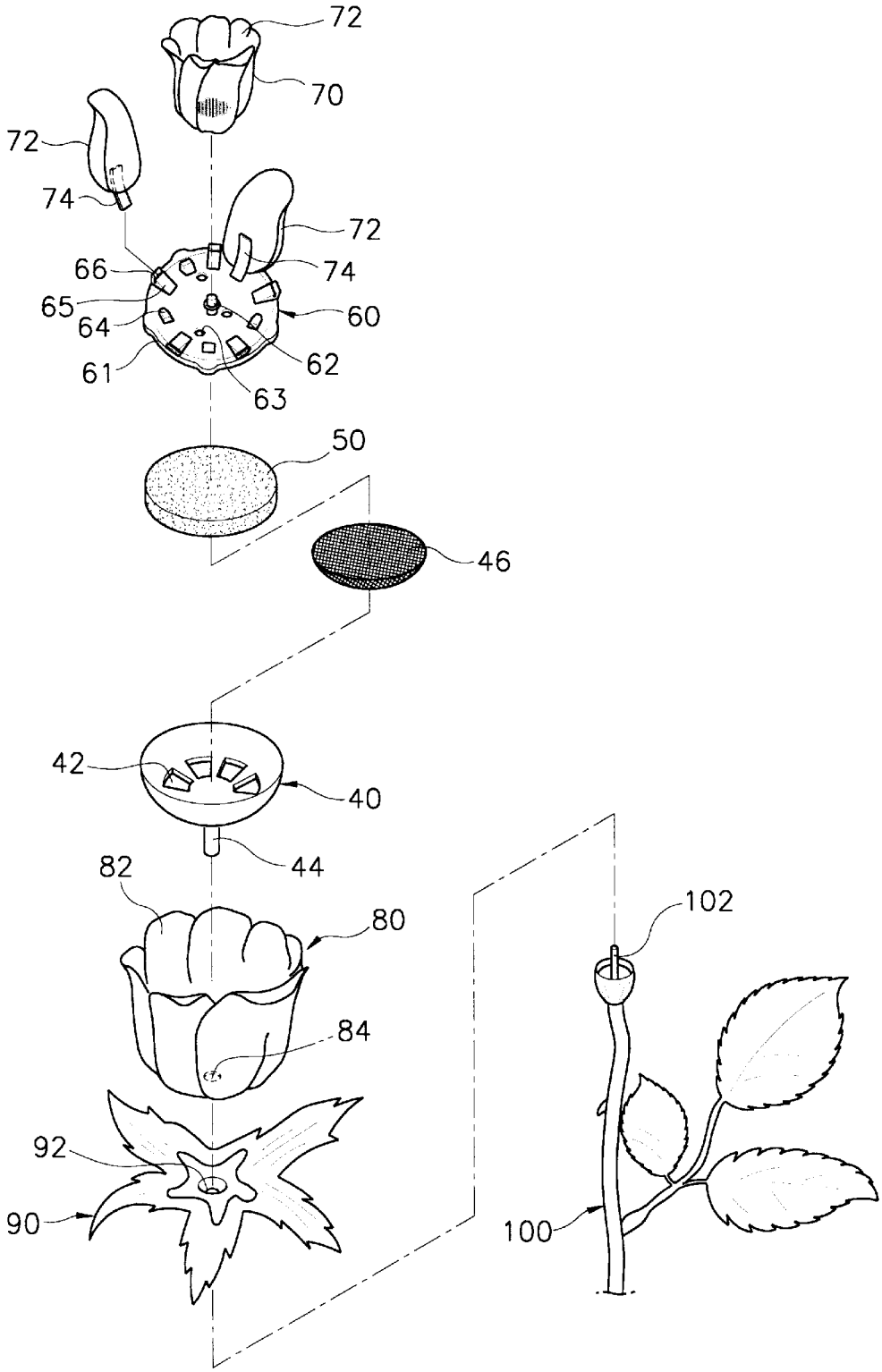
Figure 7:
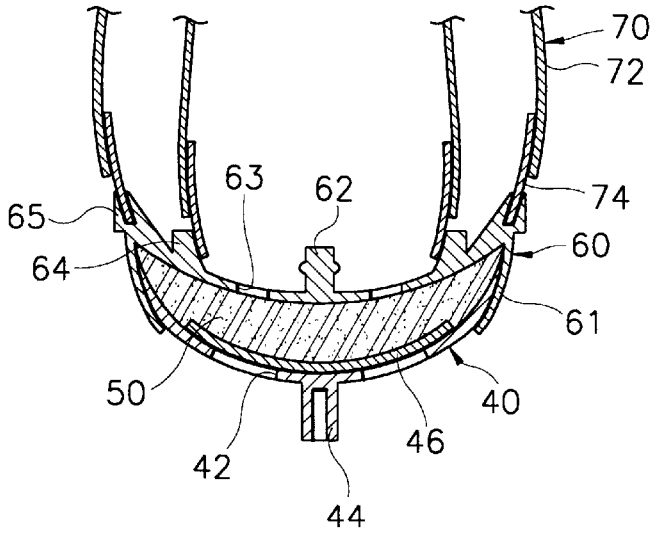

When a predetermined quantity of liquid (water) is supplied to an upper central part of the inner petal member 70 in a flowering state illustrated in FIG. 5, the liquid drops to an upper surface of the flexible member 50 as shown in FIG. 7, and, at the same time, is infused through the plurality of through holes 63 formed at the flexible member 60 to thereby be absorbed by the expansion member 50 intrinsically disposed between the body 40 and the flexible member 60.

At this time, the expansion member 50 serves to absorb the liquid and expand according to characteristics of the acrylic acid polymer natrium salt, whereby, an upper surface of the flexible member 60 is upwardly and convexly moved in flexible motion to raise the hinge shaft 62 centrally protruded at the upper surface of the flexible member 60, such that the inner petal members 70 coupled to the hinge shaft 62 are raised.

Furthermore, slant angles of the plurality of first and second slant protruders 64 and 65 formed at upper circumferential areas of the flexible member 60 are further unfolded from center of the hinge shaft 62 to simultaneously unfold the wing units 72 respectively attached by the root unit 74 to the plurality of first and second slant protruders 64 and 65.

The root units 74 of inner petal members 70 attached to the plurality of second slant protruders 65 are respectively attached to the wing unit 82 of the outer petal members 80, such that the outer petal members 80 are simultaneously unfolded when the inner petal members 70 are unfolded outwardly.

Accordingly, when the upper surface of the flexible member 60 is convexly and upwardly expanded, depicting a curved line, the inner petal members 70 coupled to the hinge shaft 62 disposed at the central upper side of the flexible member 60 are raised upwards to slowly unfold the plurality of wing units 72 outwardly, whereas, the wing units 72 of the inner petal members 70 respectively coupled to the plurality of first slant protruders formed at upper external circumference of the flexible member 60 are unfolded each at a wider angle than the inner petal member 70 coupled to the hinge shaft 62, and wing units 72 and 82 of inner and outer petal members 70 and 80 respectively attached to the plurality of second protruders 65 formed at upper external circumferential portions of the flexible member 60 are unfolded, each at a wider angle than the wing unit 72 of the inner petal member 70 attached to the first slant protruder 64, such that the entire inner and outer petal members 70 and 80 take shapes of outwardly-unfolded petals.

Figure 8:
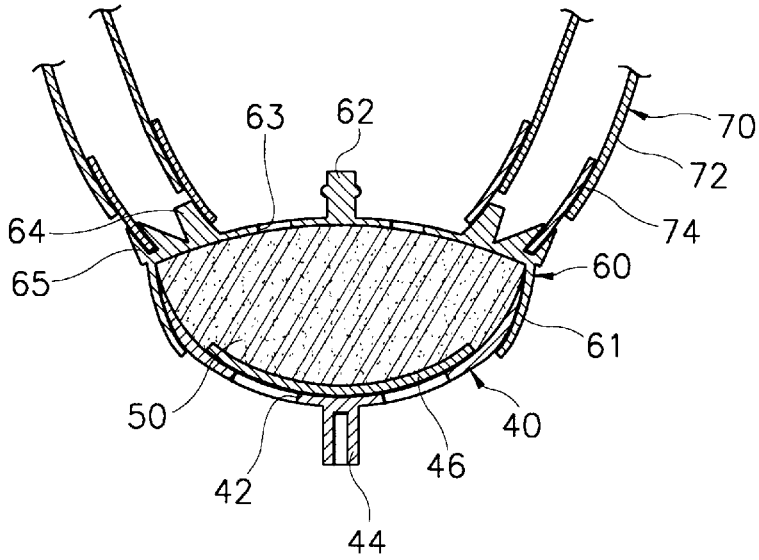

Meanwhile, as illustrated in FIG. 8, when the liquid absorbed by the expansion member 50 is evaporated to the atmosphere through the plurality of drainage holes 42 perforated around the floor of the body 40 and through tie through holes 63 perforated around the upper surface of the flexible member 60, the expansion member 50 is gradually shrunk according to properties of the acrylic acid polymer natrium salt, whereby, the flexible member 60 is drooped downwardly at an upper surface thereof by intrinsic flexibility to return to curved concave shape as illustrated in FIG. 7 when the expansion member 50 is shrunk.

The hinge shaft 62 disposed at an upper side of the flexible member 60 drops according to drooping movement of the flexible member 60 to thereby lower the inner petal members 70 coupled to the hinge shaft 62. Furthermore, slant angles of the plurality of first and second slant protruders 64 and 65 formed at upper external circumference or the flexible member 60 is inwardly narrowed from the center of the flexible member 60 to simultaneously and inwardly fold the wing units 72 respectively attached to the plurality of first and second slant protruders 64 and 65 by the root unit 74.

Successively, because the root units 74 of the inner petal member 70 formed at the plurality of the second slant protruders 65 are respectively mounted at the wing unit 82 of the outer petal member 80, the outer petal member 80 is also folded when the inner petal member 70 is inwardly curled up.

Accordingly, when the upper surface of the flexible member 60 is concavely shrunk, depicting a downwardly curved line, the inner petal member 70 coupled to the hinge shaft 62 formed at an upper central portion of the flexible member 60 is moved downwardly to gradually and inwardly curl up the plurality of wing units 72, while the wing units 72 of inner petal member 70 respectively joined to the plurality of first slant protruders 64 disposed at upper external circumference of the flexible member 60 are folded each at a narrow angle toward the inner petal member 70 coupled to the hinge shaft 62, whereby tile wing units 72 and 82 of the inner and outer petal member 70 and 80 respectively connected to the plurality of second slant protruders 65 formed at upper external circumference of the flexible member 60 are curled up each at a narrow angle toward the wing unit 72 of the inner petal member 70 attached to the first slant protruder 64 to allow the entire inner and outer petal members 70 and 80 to take shapes of curled-up petals as illustrated in FIG. 5.

As apparent from foregoing, there is an advantageous effect in the opening/closing apparatus of petals of artificial flowers according to the first, second and third embodiment of the present invention, in that petal members cooperatively moved by mechanical apparatus according to expansion member expanded or shrunk by water unfold and fold in the similar way as those of the natural flowers do, thereby enhancing merchantile value of an artificial flower.

What is claimed is:

1. An opening/closing apparatus of petals of artificial flowers, the opening/closing apparatus of petals of artificial flowers comprising:

a body with an upper side;

an expansion member disposed above the body to expand when liquid is absorbed or to shrink when the liquid is evaporated;

a flexible member coupled to the upper side of the body to flexibly move vertically according to expansion or shrinkage of the expansion member; and a plurality of petal members attached to center and peripheral sides of the flexible member, each spaced relative to the upper side of the flexible member to outwardly unfold when the upper side of the flexible member is convexly and upwardly elongated or to inwardly fold when the upper side of the flexible member is concavely and downwardly shrunk.

2. The apparatus as defined in claim 1, wherein the body comprising:

a plurality of drainage holes formed at a circumferential floor thereof for allowing the liquid to be drained out and evaporated; and a connecting shaft centrally protruded at an external lower surface thereof for connecting calyx member and petiole member.

3. The apparatus as defined in claim 1, wherein the body is formed thereon with a mesh member for covering drainage holes.

4. The apparatus as defined in claim 1, wherein the flexible member is formed at an inner upper circumference thereof with a plurality of through holes for the liquid to pass therethrough.

5. The apparatus as defined in claim 1, wherein the flexible member is integrally formed at an upper external circumference thereof with a plurality of first and second slant protruders each at a predetermined space therebetween for inner petal members to be attached thereto.

6. The apparatus as defined in claim 5, wherein the plurality of first and second slant protruders are alternatively positioned each at a predetermined space therebetween relative to an upper external circumference of the flexible member, where the plurality of second slant protruders are more externally positioned than the plurality of the first slant protruders.

7. The apparatus as defined in claim 1, wherein the expansion member is stacked and compressed multiple layers.

8. The apparatus as defined in claim 1, wherein the expansion member is acrylic acid polymer natrium salt.

* * * * *